US007574849B2

(12) United States Patent
Gottlieb

(10) Patent No.: US 7,574,849 B2
(45) Date of Patent: Aug. 18, 2009

(54) HORSE MOUNTING AID ASSEMBLY

(76) Inventor: Robert G. Gottlieb, 15803 Mill Point Dr., Houston, TX (US) 77059

( * ) Notice: Subject to any disclaimer, the term of this patent is extended or adjusted under 35 U.S.C. 154(b) by 70 days.

(21) Appl. No.: 11/796,060

(22) Filed: Apr. 26, 2007

(65) Prior Publication Data

US 2008/0264004 A1 Oct. 30, 2008

(51) Int. Cl.
*B68C 3/00* (2006.01)

(52) U.S. Cl. ..... 54/47

(58) Field of Classification Search ..... 54/47–49, 54/49.5

See application file for complete search history.

(56) References Cited

U.S. PATENT DOCUMENTS

| | | | | | |
|---|---|---|---|---|---|
| 16,032 | A * | 11/1856 | Trussell | ..... | 54/49 |
| 70,053 | A * | 10/1867 | Weddington | ..... | 54/49 |
| 261,733 | A * | 7/1882 | Larcom | ..... | 54/47 |
| 717,850 | A * | 1/1903 | Hey et al. | ..... | 54/47 |
| 1,062,327 | A * | 5/1913 | Erbe | ..... | 54/49 |
| 4,761,938 | A * | 8/1988 | Townsend | ..... | 54/47 |
| 5,809,754 | A * | 9/1998 | Schulte | ..... | 54/47 |
| 6,173,558 | B1 * | 1/2001 | Burke, Jr. | ..... | 54/47 |
| 6,282,872 | B1 * | 9/2001 | Schulte | ..... | 54/49 |
| 7,380,390 | B1 * | 6/2008 | Brassfield | ..... | 54/47 |

* cited by examiner

*Primary Examiner*—Son T. Nguyen
(74) *Attorney, Agent, or Firm*—Malcom Litman; Polsinelli Shughart PC

(57) ABSTRACT

A mounting horse aid for attachment to a stirrup iron lowers the distance between a step, on which a rider steps to swing into a saddle and the ground. The attachment is pivotally mountable on the stirrup iron and is pivotally movable between a normally latched position, covering the rider's boot and an unlatched position to provide the lowered step for a rider.

2 Claims, 3 Drawing Sheets

HORSE MOUNTING AID ASSEMBLY

BACKGROUND OF THE INVENTION

This invention relates to the field of horsemanship and equestrian equipment, and more particularly to an assembly adapted for attaching to a stirrup mountable on a horse.

The stirrups form parts of conventional horse mounting equipment; they are positioned on both sides of the saddle and assist a rider in mounting a horse. Depending on the length of the leather attaching the stirrup irons, the bottom of the stirrup is located at a pre-determined height above the ground. However, for children and people with disabilities or simply short persons, mounting on a horse equipped with conventional riding equipment presents an insurmountable difficulty. Special arrangements have to be made to lift the person up to enable the person to reach the stirrup and allow the person to mount the horse.

Some individuals require that the stirrups be elevated during horseback riding due to their physical limitations. The shorter straps holding the stirrups, which are comfortable during riding, present an additional difficulty to the person when mounting a horse since the bottom of the stirrup iron is positioned higher than usual.

The present invention contemplates elimination of drawbacks associated with prior solutions and provision of an attachment that can be secured to the conventional stirrup to assist a person when mounting a horse from the ground.

SUMMARY OF THE INVENTION

It is, therefore, an object of the present invention to provide an attachment for equestrian equipment that can be used as an aid to conventional stirrups to facilitate horse mounting.

It is another object of the present invention to provide an attachment for equestrian equipment that allows the rider's foot to be safely positioned in the stirrup without interfering with safety during riding and dismounting.

These and other objects of the invention are achieved through a provision of a horse mounting aid assembly for attachment to a Western-style stirrup iron or an English-style stirrup iron. The stirrup has a bottom portion, a top portion, and a pair of opposed side portions. The mounting aid assembly comprises a hollow body pivotally mountable on the stirrup iron, the body defining a first edge, on which a boot or shoe of a rider is receivable, a second edge, an attachment means formed between the first edge and the second edge for securing the body to the stirrup iron, and a means for detachably securing the second edge to the top portion.

When the device is unlatched from its normally latched position and is pivoted downwardly, the first edge extends at a distance below the bottom portion of the stirrup iron and assists a rider in mounting the horse.

BRIEF DESCRIPTION OF THE DRAWINGS

Reference will now be made to the drawings, wherein like parts are designated by like numerals.

DETAILED DESCRIPTION OF THE PREFERRED EMBODIMENT

Figure 1:
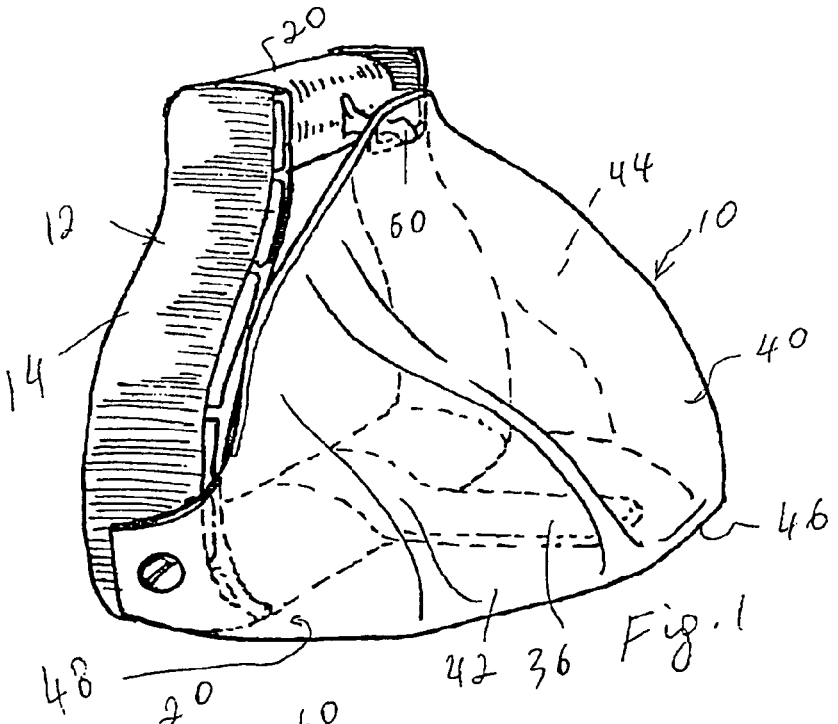
FIG. 1 is a perspective view of the mounting aid assembly in accordance with the first embodiment of the present invention secured on a stirrup, in a latched position.

Turning now to the drawings in more detail, numeral 10 designates the stirrup aid assembly, or mounting aid assembly device in accordance with the first embodiment of the present invention, particularly adapted for use with a Western-style stirrup, or stirrup iron 12. As can be seen in the drawing, the stirrup 12 is conventional in a sense that it has a pair of opposed side portions 14 and 16 connected on the bottom by a bottom portion 18. The stirrup 12 has an upper bridge portion 20, to which stirrup leather (not shown) is normally attached.

The device 10 comprises a body 30 which defines a cavity for receiving at least a portion of a rider's foot therein. The body 30 carries a latching member 32 adapted for engagement with a latch 60 positioned on the upper bridge portion 20. A sleeve 34 is configured for positioning on the bottom portion 18 of the stirrup iron 12 and a safety member 36 is secured to the sleeve 34 extending outwardly therefrom. The body 30 has solid walls defining a central part 40 and a pair of side parts 42, 44. The body 30 parts 40, 42, and 44 are unitary connected to each other to form a shield for the rider's foot 41, as will be described in more detail hereinafter.

A lower peripheral edge 46 of the body 30 defines an opening 48, while an upper peripheral edge 50 defines an upper opening 52. The body 30 is pivotally engaged to the side portions 14 and 16 of the stirrup iron 12. The body 30 comprises a pair of stirrup engaging portions 54. Although only one stirrup engaging portion 54 can be seen in FIGS. 1 and 2, it will be understood that a mirror-image stirrup engaging portion is provided for engaging the side portion 16 of the stirrup iron 12.

The stirrup-engaging portions 54 receive a pivot pin 56 through aligned openings formed therein. The pivot pin 56 extends through the stirrup-engaging portions 54 and through the thickness of the side portions 14 and 16, securing the body 30 on the stirrup iron 12 and allowing the body 30 to pivot about the axis formed by the pivot pin 56.

The sleeve 34 is configured for mounting on the bottom portion 18 on the stirrup iron 12 with the safety member 36 extending in a generally parallel orientation to a horizontal surface of the bottom portion 18 and transversely to a longitudinal axis of the bottom portion 18. The safety member 36 prevents the rider's foot 41 from being entangled in the body when riding the horse, when dismounting a horse, or when a rider falls from a horse.

The latch 60 secured to the upper bridge portion 20 of the stirrup iron 12 is designed to engage the latching member 32 of the body 30 when the body 30 is pivotally moved upwardly into abutting engagement with the stirrup iron 12. The latch 60 and the latching member 32 retain the body 30 is a latched position, as shown in FIG. 1, during riding.

In operation, the body 30 is secured to the stirrup iron 12 using the pivot pin 56. When a rider is about to mount a horse, the body 30 is pivoted in the direction of arrow 62 to an unlatched position shown in FIG. 2. The peripheral edge 46 is located below the bottom portion 18 of the stirrup iron 12 to degree allowed by the distance between the bottom portion 18 and the peripheral edge 46. Depending on the size of the aid body 30, this distance can be 6 inches or greater. As a result, the distance between the ground and the step formed by the body 30 is less than the distance between the ground and the bottom portion 18.

Figure 2:
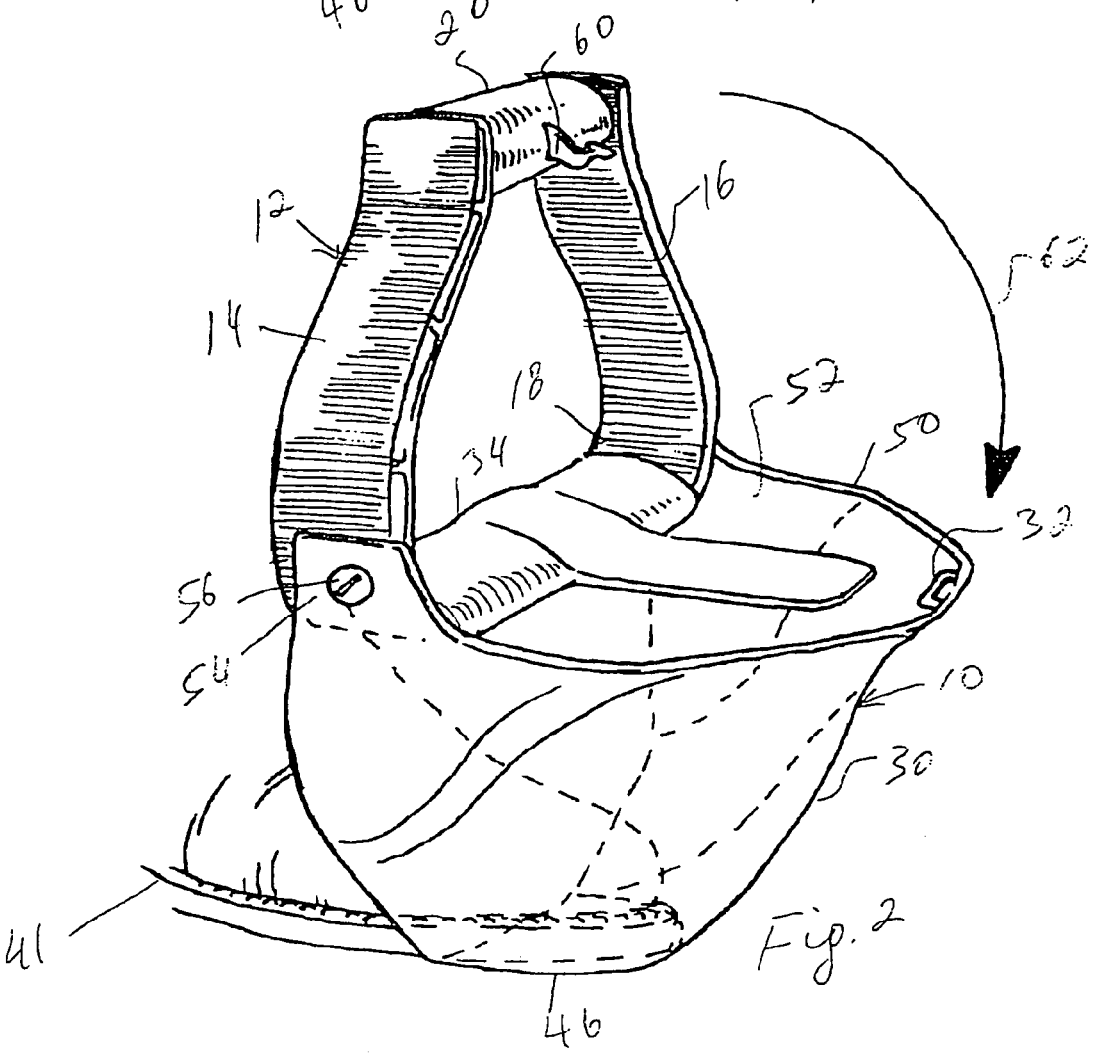
FIG. 2 is a perspective view of the device in accordance with the first embodiment of the present invention in an unlatched position.

The user positions his boot 41 on the edge 46, as shown in FIG. 2, and then swings into the saddle in a usual manner. Once both feet are engaged with respective stirrups 12, the user pushes on the device body 30, causing the body 30 to pivot upwardly and the latching member 32 to engage with the latch 60. The safety member 36 extends inside the cavity defined by body 30, as shown in FIG. 1, and prevents the user's foot from entangling in the body 30 in case of a fall. When not in use the aid device 30 can be retained in a latched position shown in FIG. 1.

The body 30 can be formed from a flexible resilient material, if desired, such as leather, synthetic material, for instance vinyl and the like. Alternatively, the body 30 can be made from a rigid material, if desired, as long as it provides sufficient support for the user's foot when mounting the horse.

Figure 3:
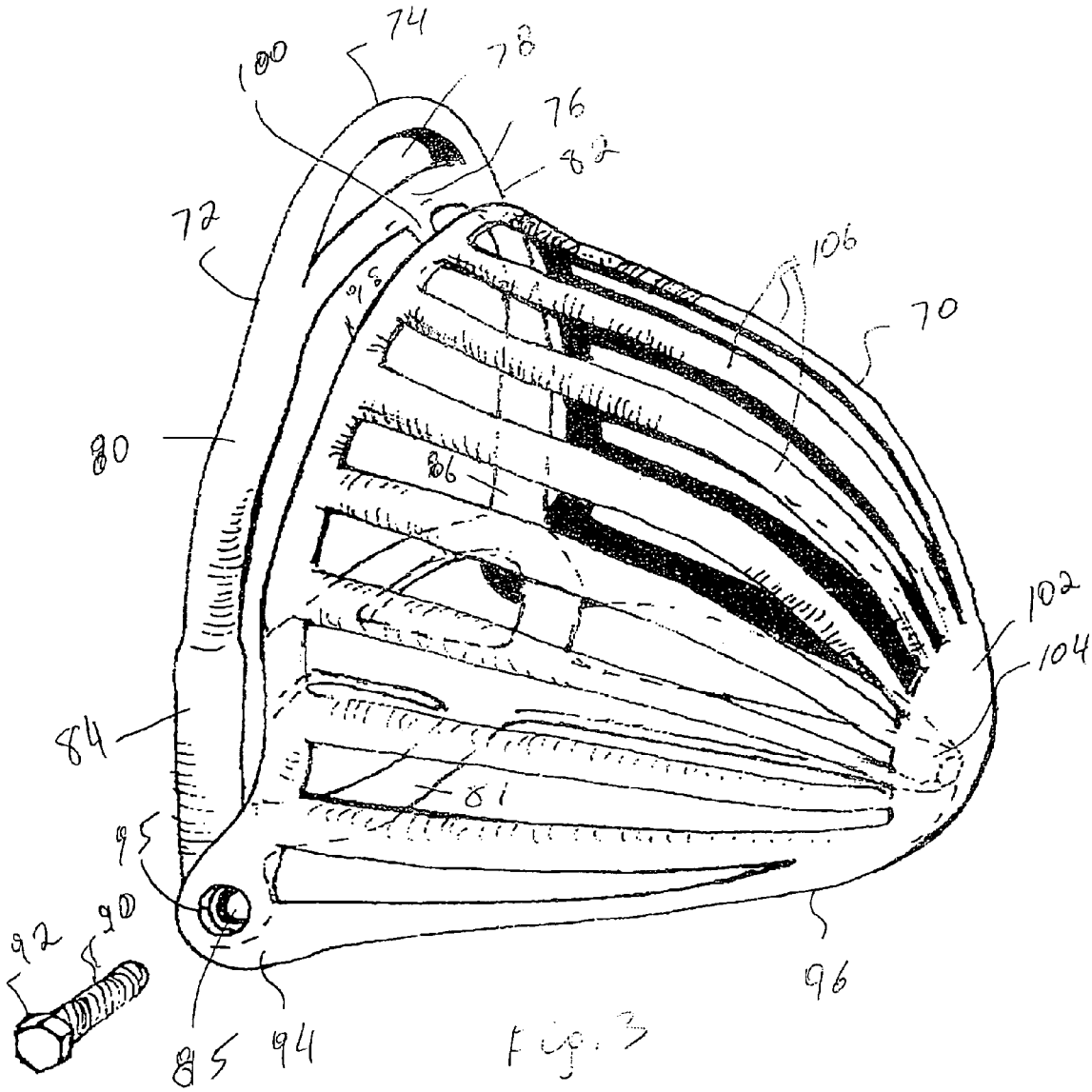
FIG. 3 is a perspective view of the second embodiment of the mounting aid assembly of the present invention in a latched position.

Turning now to the second embodiment of the present invention shown in FIG. 3, a mounting aid device 70 is shown in detail partially secured on an English-style stirrup, or stirrup iron 72. The stirrup 72 has an upper ridge 74 and an intermediate bridge 76. An opening 78 is formed between the bridges 74 and 76 to allow engagement with the stirrup leather (not shown). The stirrup iron 72 has a pair of opposed side portions 80 and 82; each side portion has a lower part, 84 and 86, respectively. The lower parts 84, 86 are provided with openings 85. The diameter of the openings 85 is sufficient to receive a pivot member 90 therethrough. Securing members 92 (only one shown in FIG. 3) prevent disengagement of the pivot member 90 from its engagement with the device 70 and the stirrup 72.

The device 70 has a pair of opposed attachment portions 94 (only one can be seen in FIG. 3), which are spaced to engage the lower parts 84 and 86 of the side portions 80, 82. Each attachment portion 94 is provided with a corresponding opening 95, which when aligned with the openings 85, receives the pivot member 90.

The mounting aid device 70 defines a lower edge 96, which serves as a step for the rider's foot in lieu of the stirrup lower portion 81. A latching member, similar to the latching member 32, is secured on the upper edge 98 of the device 70. The latching member engages with a latch 100 secured to the intermediate bridge 76 of the stirrup 72 when the device 70 is not in use.

The device 70 further comprises a bottom plate 102, from which a plurality of elongated spaced bars 106 radiate. The bars 106 extend between the hub defined by the plate 102 and the upper edge 98 of the device 70, forming a cage, which protects the rider's foot when riding. A safety member 104, similar to the safety member 36, extends within the cage defined by the device 70. The safety member 104 is secured to the bottom portion 81 of the stirrup 72 and extends in a generally horizontal relationship transversely to the longitudinal axis of the bottom portion 81.

Figure 4:
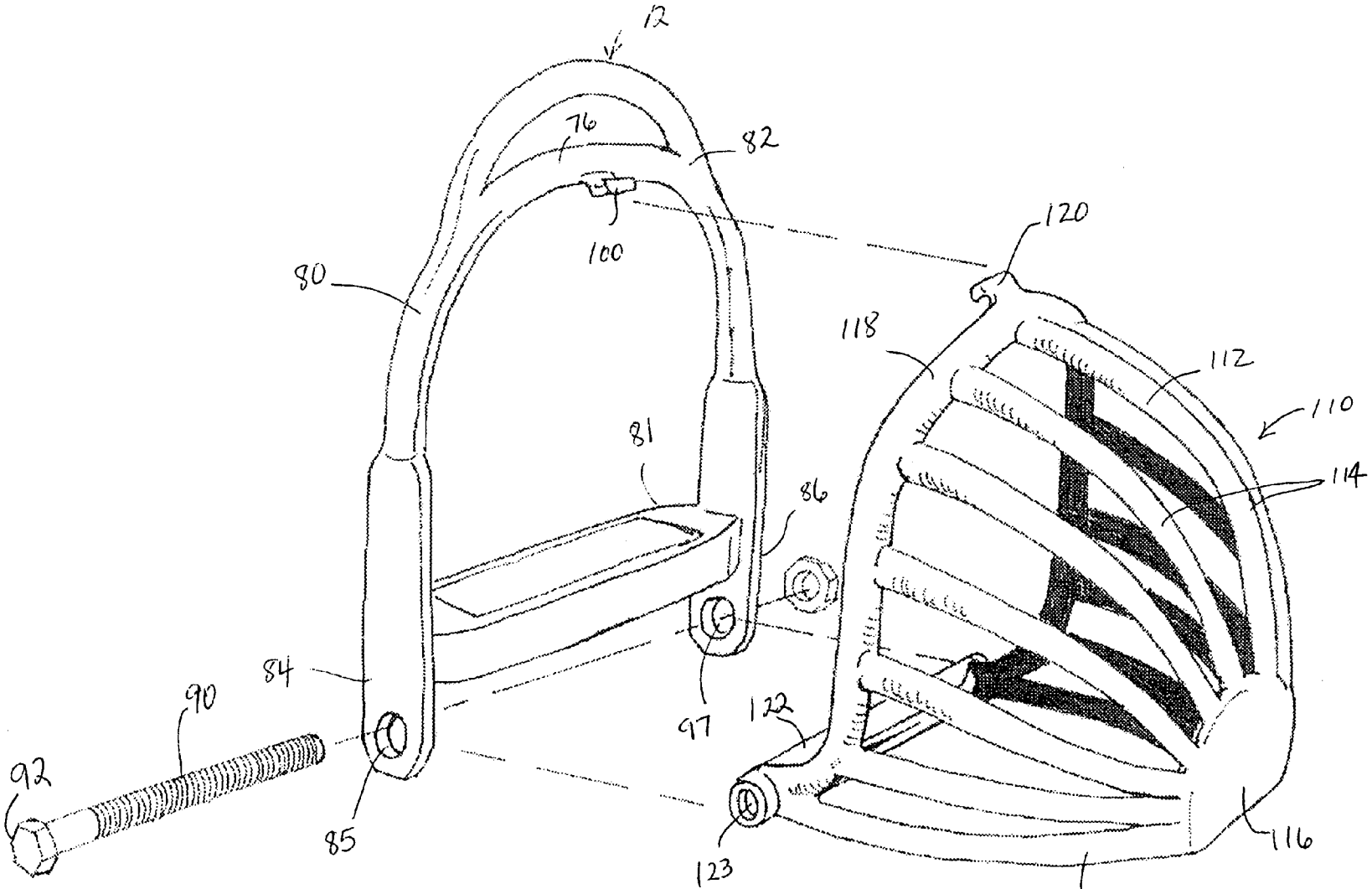
FIG. 4 is a perspective view of the mounting aid assembly according to the third embodiment of the present invention.

FIG. 4 illustrates a modification of the mounting aid device of the second embodiment. In this embodiment, the mounting aid device is designated by numeral 110. The device 110 is adapted for securing on an English-style stirrup, or stirrup iron 72, the structure of which was discussed above. The device 110 comprises a cage 112 formed by a plurality of elongated bars 114, which radiate from a bottom plate 116. A lower edge 118 of the cage 112 serves as a step for the rider's foot when mounting a horse. An upper edge 118 carries a latching member 120 adapted for engaging the latch 100 secured to the stirrup 72.

A securing sleeve 122 extends across the cage 112. The sleeve 122 is sized to fit between the lower parts 84, 86 of the side portions 80, 82. The sleeve 122 is provided with a through opening 123, which is sized to accommodate the pivot member 90 when the opening 123 is aligned with the openings 85, 97 formed in the lower parts 84, 86. Although not shown in FIG. 4, the device 110 can be provided with a safety member, similar to the safety member 104 of the embodiment shown in FIG. 3.

In use, the devices 70 or 110 are secured to the stirrup 72 in a pivotal relationship, allowing the body cages to swing toward and away from the stirrup 72. When in a latched position shown in FIG. 3, the devices 70 and 110 are secured through the engagement of the latching members with the latch 100. When the rider needs to mount a horse, the latching members are disengaged and the cages 70 or 112 are pivoted outwardly and downwardly from the stirrup 72. The bottom plates 102 or 116 are oriented generally horizontally and are located below the bottom portion 81 of the stirrup 72. The distance of the stepping surfaces of the device 70, 110 from the lower portion 81 can be 6 inches or more. The rider rests a toe of the footwear in the device 70 or 110 and the mounts the saddle in the usual manner.

The cages 70, 112, similarly to the attachment 10, can be made from natural or synthetic material, such as leather, plastic or other lightweight synthetic material that is sturdy enough to allow support of the rider's body while not adding any substantial weight to the equestrian equipment. It will be understood that the size of the device 10, 70 and 110 can differ, depending on the desired length of the stirrup attachment to accommodate a child or a grown person. Each of the device bodies can be configured so that a predetermined distance from the ground is afforded for each rider for mounting the horse. The stepping surfaces, on which the rider's foot temporarily rests, can be dimensioned for accommodating different types of footwear, boots, shoes, etc. If desired, the device 10, 70 and 110 can be made as a one-piece molded unit. The safety members 36 and 104 are useful in preventing the rider's foot from entangling in the attachment or in the stirrup, particularly if the rider falls or is thrown from the horse.

When not in use and in a latched position, the device 10, 70, or 10 protect the rider's foot by shielding the foot and absorbing an impact force from contact with stones, tree branches and the like. The assembly 10, 70, or 110 can be provided for both stirrups to accommodate different riders.

Many other changes and modifications can be made in the design of the present invention without departing from the spirit thereof. I, therefore, pray that my rights to the present invention be limited only by the scope of the appended claims.

I claim:

1. A horse mounting aid assembly for attachment to a stirrup iron, the stirrup iron having a bottom portion, a top portion, and a pair of opposed side portions, the horse mounting aid assembly comprising:

a hollow body comprising a cage formed from elongated bar members radiating from a hub, said hub being formed by a bottom plate of said body, said body being configured for pivotal securing on the stirrup iron and pivoting between a first, an in-use position receiving a boot or shoe of a rider and a second, non-use position, the body defining a first edge for receiving a boot or shoe of the rider, a second edge and an attachment means formed between the first edge and the second edge, the attachment means being configured for securing said body to the stirrup iron, said first edge being configured for extending at a distance below the bottom portion of the stirrup iron when the body is pivoted into the in-use position.

2. A horse mounting aid assembly for attachment to a stirrup iron, the stirrup iron having a bottom portion, a top portion, and a pair of opposed side portions, the device comprising:

a hollow body comprising a cage formed from elongated bar members radiating from a hub, said hub being formed by a bottom plate of said body, said body being configured for pivotal mounting on the stirrup iron for moving between a first, in-use position, receiving a boot or shoe of a rider, and a second, non-use position, said body defining a first edge configured for receiving a boot or shoe of a rider, a second edge, an attachment means formed between the first edge and the second edge, said attachment means being configured for securing the body to the stirrup iron, and a means for detachably securing the second edge to the stirrup iron, said first edge being configured for extending at a distance below the bottom portion of the stirrup iron when the body is pivoted into the in-use position.

* * * * *